US005630012A

United States Patent [19]

Nishiguchi et al.

[11] Patent Number: 5,630,012

[45] Date of Patent: May 13, 1997

[54] SPEECH EFFICIENT CODING METHOD

[75] Inventors: Masayuki Nishiguchi, Kanagawa; Jun Matsumoto; Joseph Chan, both of Tokyo, all of Japan

[73] Assignee: Sony Corporation, Tokyo, Japan

[21] Appl. No.: 280,617

[22] Filed: Jul. 26, 1994

[30] Foreign Application Priority Data

Jul. 27, 1993 [JP] Japan ..... 5-185324

[51] Int. Cl.[6] ..... G10L 3/02; G10L 9/00

[52] U.S. Cl. ..... 395/2.17; 395/2.16; 395/2.14; 395/2.1

[58] Field of Search ..... 395/2.16, 2.17, 395/2.19, 2.32, 2.22, 2.23, 2.3, 2.18, 2.47, 2.48, 2.46, 2.52, 2.31, 2.12, 2.1, 2.14; 381/38, 37, 39

[56] References Cited

U.S. PATENT DOCUMENTS 5,473,727 12/1995 Nishiguchi et al. ..... 395/2.17

FOREIGN PATENT DOCUMENTS

0590155 A1 4/1994 European Pat. Off. .

OTHER PUBLICATIONS

ICASSP 85 Proceedings, Tampa, USA, IEEE, Acoustics, Speech And Signal Processing Society, vol. 2, 1985, pp. 513–516, J. S. Lim: "A New Model–Based Speech Analysis/Synthesis System."

Speech Processing, Minneapolis, USA, Apr. 27–30, 1993, vol. 2 of 5, 27 Apr. 1993, Institute Of Electrical And Electronics Engineers, pp. 11–151–154, XP000427748 Nishiguchi M et al: "Vector Quantized MBE With simplified V/UV Division At 3.OKBPS."

Speech Processing 1, Albuquerque, USA, Apr. 3–6, 1990, vol. 1, 3 Apr. 1990, Institute Of Electrical And Electronics Engineers, pp. 249–252, XP000146452, McAulay R. J. et al: "Pitch Estimation And Voicing Detection Based On A Sinusoidal Speech Model 1."

Griffin Daniel W., Lim Jae S., Multiband Excitation Vocoder, IEEE Trans Acous Sp & Sig Proc, vol. 36 No. 8 Aug. 1988.

Nishiguchi N, et al, Vector Quantized MBE with Simplif. V/UV Div. at 3.0 KBPS, IEEE ICASSP–93 Apr. 1993.

Furui, S, Digital Speech Processing, Synthesis, and Recognition, Tokyo: Tokai Univ. Press Sep. 1985.

*Primary Examiner*—Allen R. MacDonald
*Assistant Examiner*—Robert Sax
*Attorney, Agent, or Firm*—Limbach & Limbach L.L.P.

[57] ABSTRACT

There is provided a speech efficient coding method applicable to, e.g., analysis by a synthesis system such as an MBE vocoder, and comprising the steps of (a) dividing an input speech signal into block units on a time base, (b) dividing signals of each of the respective divided blocks into signals in a plurality of frequency bands, (c) discriminating whether signals of each of the respective divided frequency bands which are lower than a first frequency are voiced sound or unvoiced sound, (d) if the discrimination results in step (c) for a predetermined number of frequency bands is voiced sound, assigning a discrimination result of voiced sound to all frequency bands lower than a second frequency which is higher than the first frequency to obtain an ultimate discrimination result of voiced sound/unvoiced sound. Thus, even in the case where the pitch suddenly changes, or the harmonics structure is not precisely in correspondence with an integer multiple of the fundamental pitch period, a stable judgment of V (Voiced Sound) can be made.

18 Claims, 7 Drawing Sheets

FIG.4A
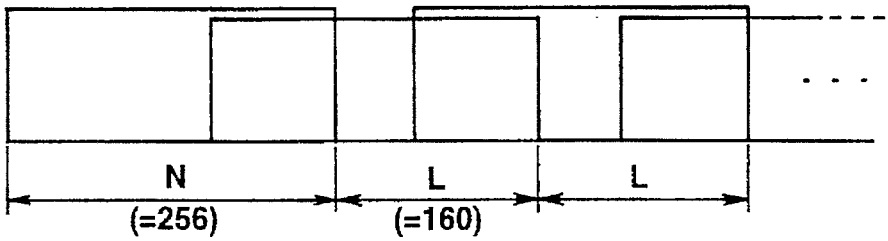
FIG.4B
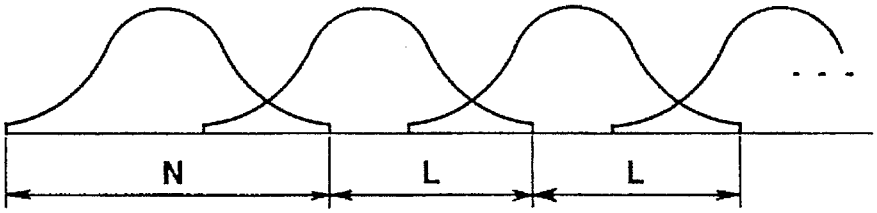
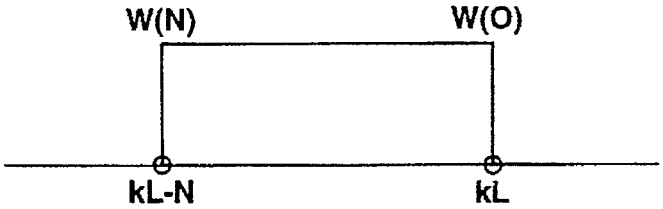
FIG.5
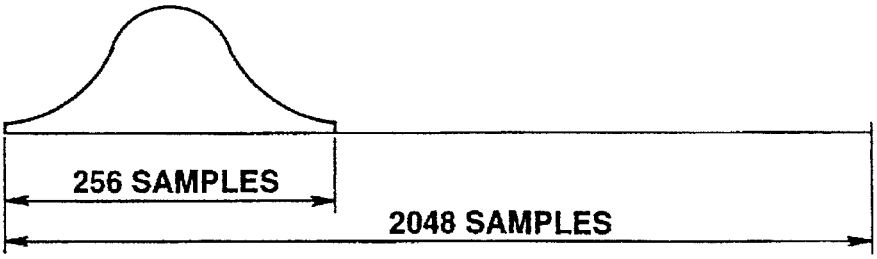
FIG.6

SPEECH EFFICIENT CODING METHOD

BACKGROUND OF THE INVENTION

1. Field of the Invention

This invention relates to such an efficient speech coding method to divide an input speech signal rate units of blocks to carry out coding processing with divided blocks being as a unit.

2. Description of the Related Art

There have been known various coding methods adapted to carry out signal compression by making use of the statistical property in the time region and the frequency region of an audio signal (including speech (voice) signal or acoustic signal) and the characteristic from a viewpoint of hearing of the human being. The coding method of this kind is further roughly classified into coding in the time region, coding in the frequency region, and analysis/synthesis coding, etc.

As an example of efficient coding of speech signal, etc., there are MBE (Multiband Excitation) coding, SBE (Singleband Excitation) coding, Harmonic coding, SBC (Sub-Band Coding), LPC (Linear Predictive Coding), DCT (Discrete Cosine Transform), MDCT (Modified DCT), or FFT (Fast Fourier Transform), etc. In such efficient coding processing, in the case of quantizing various information data such as spectrum amplitude or their parameters (LSP parameter, $\alpha$ parameter, k parameter, etc.) there are many cases where scalar quantization is conventionally carried out.

In the speech (voice) analysis/synthesis system such as PARCOR method, etc., since timing for switching excitation source is given every block (frame) on the time base, voiced sound and unvoiced sound cannot be mixed within the same frame. As a result, high quality speech (voice) could not be obtained.

On the contrary, in the above-mentioned MBE coding, since voiced sound/unvoiced sound discriminations (V/UV discrimination) are carried out on the basis of spectrum shape in bands every respective bands (frequency bands) obtained by combining respective harmonics of the frequency spectrum or 2~3 harmonics thereof, or every bands divided by fixed frequency band width (e.g., 300~400 Hz) with respect to speech signals (signal components) within one block (frame), improvement in the sound quality is concluded. Such V/UV discriminations for each of the respective bands are carried out chiefly in dependency upon the degree of existence (occurrence) of harmonics in the spectra within those bands.

However, if, e.g., the pitch suddenly changes within one block (e.g., 256 samples), a so called "indistinctness" (obscurity) may take place particularly in the medium~high frequency band as shown in FIG. 1, for example, in that spectrum structure. Moreover, as shown in FIG. 2, there are instances where harmonics do not necessarily exist at frequencies which are an integer multiple of the fundamental period, or there are instances where detention accuracy of the pitch is insufficient. Under such circumstances, when V/UV discriminations for all the respective bands are carried out in accordance with the conventional system, any inconvenience takes place in spectrum matching in V/UV discrimination, i.e., matching between the currently inputted signal spectrum and the spectrum which has been synthesized up to that time for every each band or each harmonic. As a result, bands or harmonics which should be discriminated to be primarily discriminated as V (Voiced Sound) may be erroneously discriminated to be UV (Unvoiced Sound). Namely, in the case shown in FIG. 1 or 2, speech signal components only on a lower frequency side are judged to be V (Voiced Sound) and speech signal components in the medium~higher frequency band are judged to be UV (Unvoiced Sound). As a result, synthetic sound may be so called easy.

In addition, also in the case where Voiced Sound/Unvoiced Sound discrimination (V/UV discrimination) is implemented to the entirety of signals (signal components) within the block, similar inconvenience may take place.

OBJECT AND SUMMARY OF THE INVENTION

With such actual circumstances in view, an object of this invention is to provide a speech efficient coding method capable of effectively carrying out discrimination between Voiced Sound and Unvoiced Sound every band (frequency band) or with respect to all signals within a block even in the case where the pitch suddenly changes or the pitch detection accuracy is not ensured.

To achieve the above-mentioned object, in accordance with this invention, there is provided a speech efficient coding method comprising the steps of dividing an input speech signal into a plurality of signal blocks in a time domain, dividing each of the signal blocks into a plurality of frequency bands in a frequency domain, determining whether a signal component in each of the frequency bands is a voiced sound component or an unvoiced sound component, determining whether the signal components in a predetermined number of frequency bands below a first frequency are the voiced sound components, and deciding that the signal components in all of the frequency bands below a second frequency higher than the first frequency are the voiced sound components or the unvoiced sound components in accordance with the determination in the preceding step.

Here, as an efficient coding method to which this invention is applied, there is a speech analysis/synthesis method using the MBE. In this MBE coding, V/UV discrimination is carried out for each frequency band, in dependency upon the result of the V/UV discrimination for each frequency band. Voiced sounds are synthesized by synthesis of a sine wave, etc. with respect to the speech signal components in the frequency band portion discriminated as V. Transform processing of a noise signal is carried out with respect to the speech signal components in the frequency band portion discriminated as UV to thereby synthesize an unvoiced sound.

Moreover, it is conceivable to employ a scheme such that when a frequency band less than a first frequency (e.g., 500~700 Hz) on a lower frequency side is discriminated as V (Voiced Sound), the discrimination result on the lower frequency side is directly employed in discrimination on a higher frequency side (hereinafter simply referred to expansion of the discrimination result) to allow a frequency band up to a second frequency (e.g., 3300 Hz) to be compulsorily voiced sound. Further, it is conceivable to employ a scheme to carry out such expansion to the higher frequency side of the voiced sound discrimination result on the lower frequency band as long as the level of an input signal is more than a predetermined threshold value, or the zero cross rate (the number of zero crosses) of an input signal is less than a predetermined value.

Furthermore, it is preferable that, prior to carrying out expansion to the higher frequency side of the discrimination result made on the lower frequency side, the V/UV discrimination band is caused to be a pattern comprised of the discrimination results of each of $N_B$ bands of which number is caused to degenerate into a predetermined number $N_B$, and such degenerate patterns are converted into V/UV discrimination result patterns having at least one change point of V/UV where the speech signal components on the lower frequency side are caused to be V and the speech signal components on the higher frequency side are caused to be UV. As such a conversion method, there is a method in which the degenerate V/UV pattern is caused to be an $N_B$ dimensional vector to prepare in advance several representative V/UV patterns having at least one change point of V/UV as representative vectors of the $N_B$ dimensions, to thus select a representative vector where the Hamming distance is a minimum. In addition, there may be employed a method to allow a frequency band less than the highest frequency band of the frequency bands where speech signal components are discriminated to be V of the V/UV discrimination result pattern to be V region, and to allow the frequency band higher than that frequency band to be UV region, thus to convert that pattern into pattern having one change point of V/UV or less As another feature, in a speech efficient coding method adapted for dividing an input speech signal into block units to implement coding processing thereto, discriminations between voiced sound and unvoiced sound is carried out on the basis of a spectrum structure on a lower frequency side for each of the respective blocks.

In accordance with the speech efficient coding method thus featured, the discrimination result of Voiced Sound/Unvoiced Sound (V/UV) in the frequency band where the harmonic structure is stable on a lower frequency side, e.g., less than 500~700 Hz is used for assistance in discriminating V/UV in the middle~higher frequency band, thereby making it possible to carry out stable discrimination of voiced sound (V) even in the case where the pitch suddenly changes, or the harmonics structure is not precisely in correspondence with an integer multiple of the fundamental period.

BRIEF DESCRIPTION OF THE DRAWINGS

FIGS. 4A and 4B are diagrams for explaining windowing processing.

FIG. 5 is an illustration for explaining the relationship between windowing processing and window function.

FIG. 6 is an illustration showing time base data subject to orthogonal transform (FFT) processing.

DESCRIPTION OF THE PREFERRED EMBODIMENT

Figure 1:
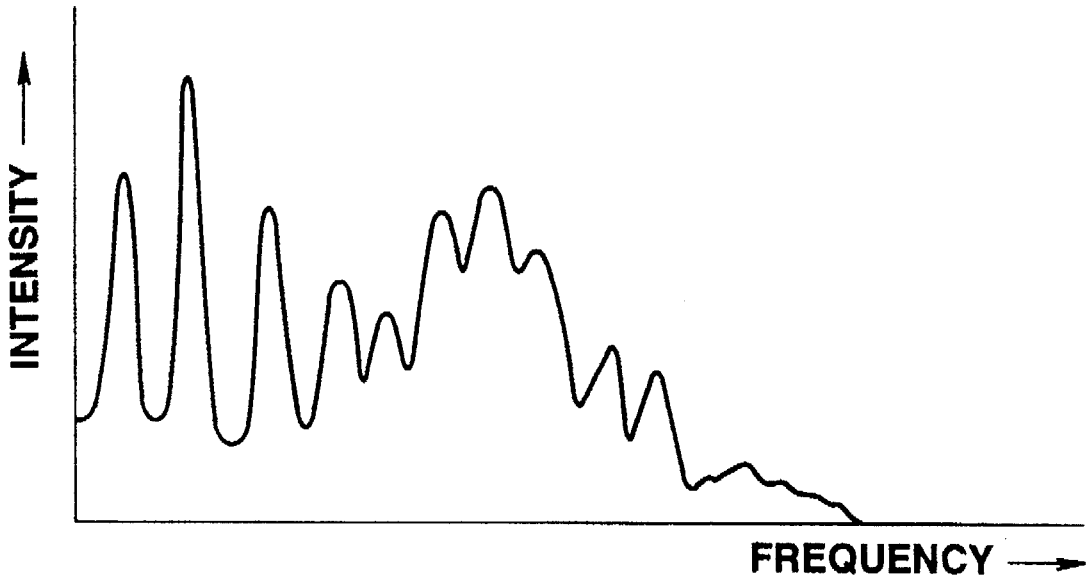
FIG.1 (PRIOR ART)
FIG. 1 is a view showing a spectrum structure where "indistinctness" takes place in the medium~higher frequency band.
Figure 2:
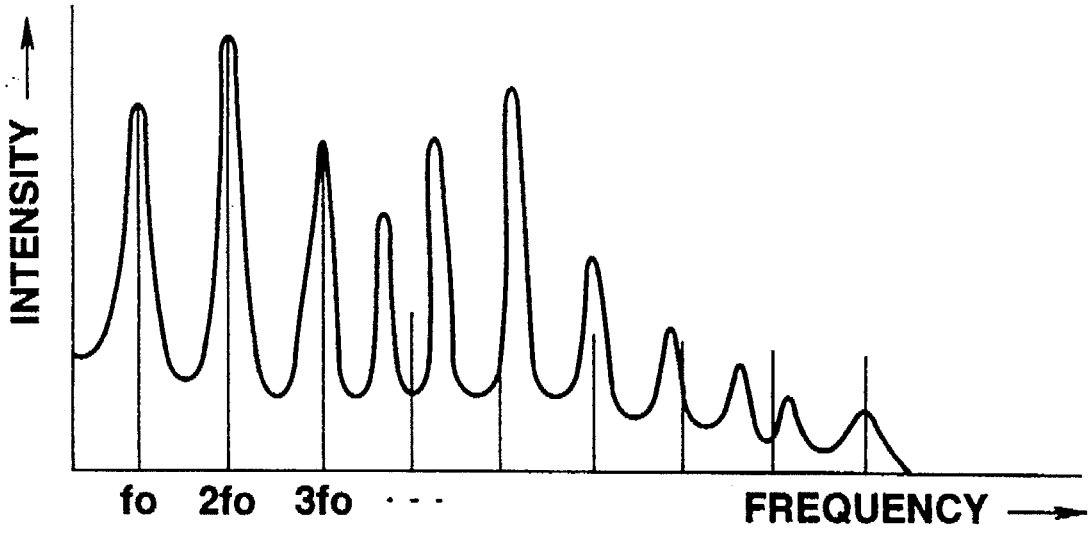
FIG.2 (PRIOR ART)
FIG. 2 is a view showing a spectrum structure where the harmonic component of a signal is not in correspondence with an integer multiple of the fundamental pitch period.

A preferred embodiment of a speech efficient coding method according to this invention will now be described.

As an efficient coding method, there can be employed a coding method such that, as in the case of MBE (Multiband Excitation) coding which will be described later, or the like, signals for each predetermined time block are transformed into signals on a frequency base to divide them into signals in a plurality of frequency bands to carry out discriminations between V (Voiced Sound) and UV (Unvoiced Sound) for each of the respective bands.

Namely, as a general efficient coding method to which this invention is applied, there is employed a method of dividing a speech signal, on the time base, into blocks of a predetermined number of samples (e.g., 256 samples) to transform speech signal components in each of the blocks into spectrum data on the frequency base by orthogonal transform such as FFT. The pitch of the speech (voice) within the block is extracted to divide the frequency based spectrum into spectrum components in plural frequency bands at intervals corresponding to this pitch in order to carry out discrimination between V (Voiced Sound) and UV (Unvoiced Sound) with respect to the respective divided bands. This V/UV discrimination information is encoded together with amplitude data of the spectrum, and such coded data is transmitted.

Now, in the case where speech analysis by synthesis system, e.g., MBE vocoder, etc. is assumed, a sampling frequency fs with respect to an input speech signal on the time base is ordinarily 8 kHz, the entire bandwidth is 3.4 kHz (effective band is 200~3400 Hz), and a pitch lag (No. of samples corresponding to the pitch period) from a high-pitched sound of a woman to a low-pitched sound of a man is about 20~147. Accordingly, pitch frequency fluctuates from 8000/147=54 (Hz) to about 8000/20=400 (Hz). Accordingly, about 8~63 pitch pulses (harmonics) exist in a frequency band up to 3.4 kHz on the frequency base.

It is preferable to reduce the number of divisional bands to a predetermined number (e.g., about 12), or allow it to degenerate thereinto by taking into consideration the fact that divisional band number (band number) changes in a range from about 8~63 every block (frame) when frequency division is made at an interval corresponding to pitch in a manner stated above.

In the embodiment of this invention, an approach is employed to determine divisional positions to carry out division between the V (Voiced Sound) area and the UV (Unvoiced Sound) area at a portion in all of the bands on the basis of V/UV discrimination information obtained for plural bands (frequency bands) divided in dependency upon pitch or for bands of which the number is caused to degenerate into a predetermined number, and to use the V/UV discrimination result on a lower frequency side as an information source for V/UV discrimination on a higher frequency side. In more practical sense, when speech signal components on the lower frequency side of less than 500~700 Hz are discriminated as V (Voiced Sound), expansion of its discrimination result to a higher frequency side is carried out to allow a frequency band up to about 3300 Hz to be compulsorily V (Voiced Sound). Such expansion is carried out as long as the level of an input signal is above a predetermined threshold value, or as long as a zero cross rate of an input signal is below a predetermined threshold value different from the above.

An actual example of a sort of MBE (Multiband Excitation) vocoder of analysis/synthesis coding apparatus (so called vocoder) for a speech signal to which a speech efficient coding method as described above can be applied will now be described with reference to the attached drawings.

The MBE vocoder described below is disclosed in D. W. Griffin and J. S. Lim, "Multiband Excitation Vocoder," IEEE Trans. Acoustics, Speech, and Signal Processing, vol. 36, No. 8, pp. 1223–1235, Aug. 1988. While a conventional PARCOR (PARtial auto-CORrelation) vocoder, etc. carries out switching between a voiced sound region and an unvoiced sound region every block or frame on the time base in modeling speech (voice), an MBE vocoder carries out modeling on the assumption that the voiced region and the unvoiced region exist in the frequency base region in the same block or frame on the time base.

Figure 3:
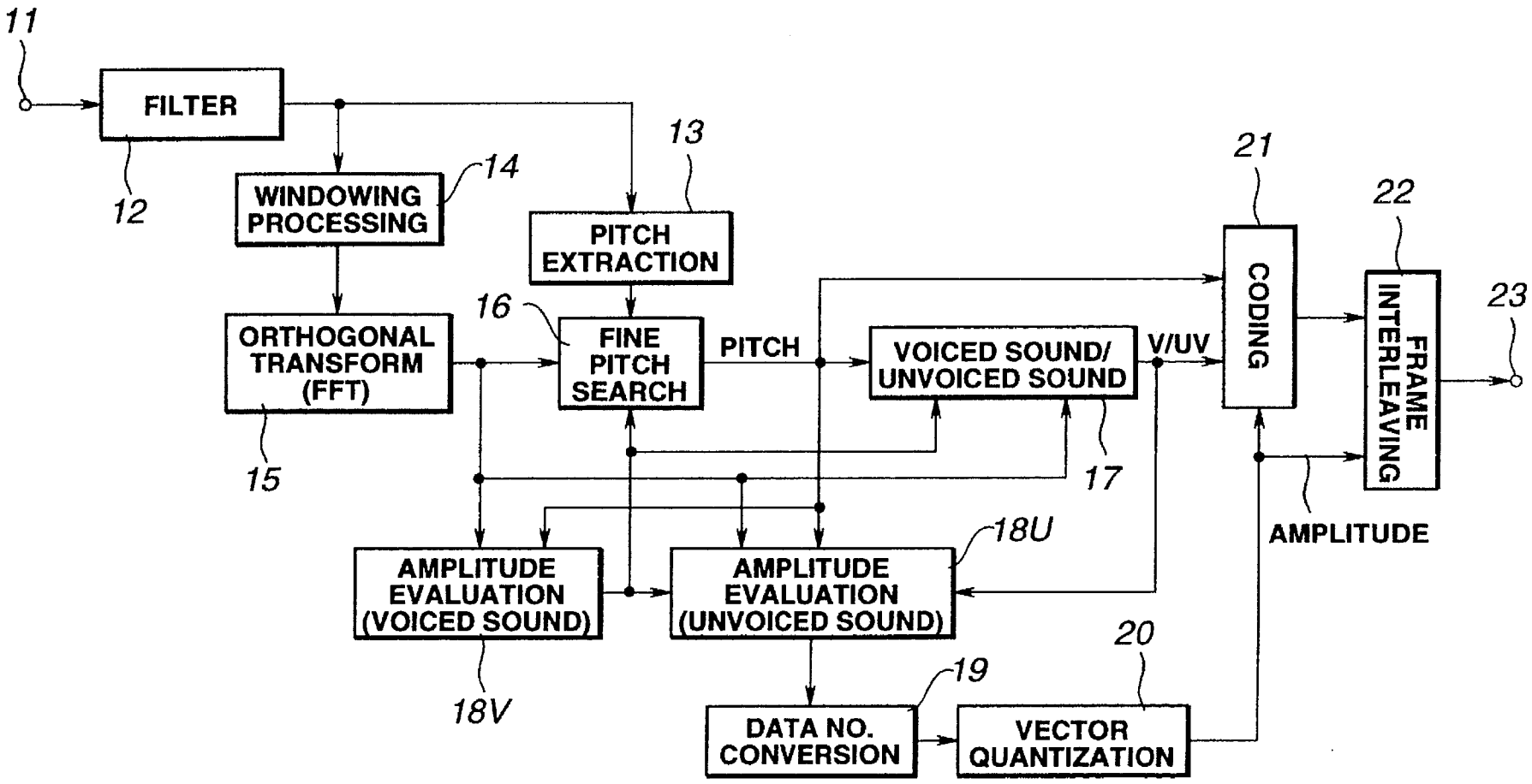
FIG. 3 is a functional block diagram showing an outline of the configuration of the analysis side (encode side) of a speech analysis/synthesis apparatus according to this invention.

FIG. 3 is a block diagram showing an outline of the configuration of the entirety of an embodiment in which this invention is applied to the MBE vocoder.

In FIG. 3, an input terminal 11 is supplied with a speech signal. This input speech signal is sent to a filter 12 such as HPF (high-pass filter), etc., at which the elimination of so called DC offset and or the elimination of a lower frequency component (less than 200 Hz) for band limitation (e.g., limitation into 200~3400 Hz) are carried out. A signal obtained through this filter 12 is sent to a pitch extraction section 13 and a windowing processing section 14. At the pitch extraction section 13, input speech signal data is divided into blocks in units of a predetermined number of samples N (e.g., N=256) (or extraction by square window is carried out). Thus, pitch extraction with respect to the speech signal within a corresponding block is carried out. Such an extracted block (of 256 samples) is shifted in a time base direction at a frame interval of L samples (e.g., L=160) as shown in FIG. 4A, for example, and the overlap between respective blocks is N-L samples (e.g., 96 samples). In addition, in the windowing processing section 14, as shown in FIG. 4B, a predetermined window function, e.g., a Hamming window is applied as shown in FIG. 4B to 1 block N samples to sequentially shift this windowed block in time base direction at an interval of one frame of L samples.

Such windowing processing is expressed by the following formula:

$$x_w(k, q) = x(q)w(kL-q) \tag{1}$$

In the above formula (1), k indicates the block No. and q indicates the time index (sample No.) of the data. It is indicated that data $x_w$ (k, q) is obtained by implementing windowing processing to the q-th data x(q) of an input signal prior to processing by using a window function w(kL–q) of the k-th block. Window function $W_r(r)$ in the case of a rectangular window as shown in FIG. 4A at pitch extraction section 13 is expressed as follows:

$$\begin{aligned} w_r(r) &= 1 \quad O \leqq r < N \\ &= 0 \quad r < O, N \leqq r \end{aligned} \tag{2}$$

Further, the window function $W_h(r)$ in the case of a Hamming window as shown in FIG. 4B at the windowing processing section 14 is expressed as follows:

$$\begin{aligned} W_h(r) &= 0.54 - 0.46\cos(2\pi r/(N-1)) \quad 0 \leqq r < N \\ &= 0 \quad r < O, N \leqq r \end{aligned} \tag{3}$$

A non-zero time period (section) of the window function W(r) (=w(kL–q)) expressed as the above formula (1) when such a window function $W_r(r)$ or $W_h(r)$ is used is expressed as follows:

$$0 \leqq kL-q < N$$

Transformation of the above formula gives:

$$kL-N < q \leqq kL$$

Accordingly, in the case of the square window, for example, the window function $W_r$(kL–q) becomes equal to 1 when kL–N<q≦kL holds as shown in FIG. 3. Moreover, the above-mentioned formulas (1)~(3) indicate that a window having a length of N (=256) samples is advanced by L (=160) samples. A train of sampled non-zero data of respective N points (0<r≦N) extracted by respective window functions expressed as the above-mentioned formulas (2), (3) are assumed to be represented by $x_{wr}$(k, r), $x_{wh}$ (k, r), respectively.

At the windowing processing section 14, as shown in FIG. 6, 0 data of 1792 samples are added to the sample train $x_{wh}$(k, r) of one block of 256 samples to which the Hamming window of the formula (3) is applied, resulting in 2048 samples. Orthogonal transform processing, e.g., FFT (Fast Fourier Transform), etc. is implemented to the time base data train of 2048 samples by using orthogonal transform section 15. It is to be noted that FFT processing may be carried out by using 256 samples as they are, without adding 0 data.

At the pitch extraction section 13, pitch extraction is carried out on the basis of the sample train of the $x_{wr}$ (k, r) (one block N samples). As this pitch extraction method, there are known methods using periodicity of time waveform, periodic frequency structure of spectrum or auto-correlation function. In this embodiment, an auto-correlation method of a center clip waveform proposed by this applicant in the PCT/JP93/00323 is adopted. With respect to the center clip level within a block at this time, one clip level may be set per one block. In this embodiment, an approach is employed to detect the peak level, etc. of signals of respective portions (sub blocks) obtained by minutely dividing the block to change stepwise or continuously clip a level within a block when differences between peak levels, etc. of respective sub blocks are large. The pitch period is determined on the basis of a peak position of auto-correlation data of the center clip waveform. At this time, an approach is employed to determine in advance a plurality of peaks from auto-correlation data (the auto-correlation function is determined from data of one block of N samples), whereby when the maximum peak of these plural peaks is above a predetermined threshold value, the maximum peak position is caused to be the pitch period, while when otherwise, a peak which falls within a pitch range which satisfies a predetermined relationship with respect to a pitch determined at a frame except for current frame, e.g., frames before and after, e.g., within the range of ±20% with, e.g., the pitch of the former frame being as the center, will determine the pitch of the current frame on the basis of this peak position. At this pitch extraction section 13, a relatively rough search of the pitch by open-loop is carried out. The pitch data thus extracted is sent to a fine pitch search section 16. Thus, the fine pitch search by the closed loop is carried out.

The fine pitch search section 16 is supplied with the rough pitch data of an integer value extracted at the pitch extraction section 13 and data on the frequency base which is caused to undergo FFT processing by the orthogonal transform section 15. At this fine pitch search section 16, a swing operation is carried out by ± several samples at 0.2~0.5 pitches with the rough pitch data value being as center to allow the current value to become close to the value of an optimum fine pitch data with a floating decimal point. As a technique of fine search at this time, a so called Analysis by Synthesis is used to select pitch so that the synthesized power spectrum becomes closest to power spectrum of the original sound.

A fine search of this pitch will now be described. Initially, in the MBE vocoder, there is assumed a model to represent S(j) as spectrum data on the frequency base which has been orthogonally transformed by the FFT, etc. by the following formula:

$$S(j)=H(j)|E(j)|\ 0<j<J \tag{4}$$

Figure 7A:
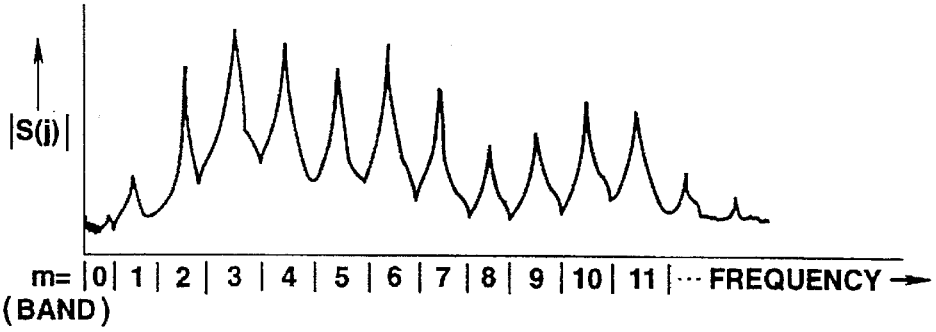
FIGS. 7A–7C are waveforms illustrating spectrum data, spectrum envelope and power spectrum of excitation signal on the frequency base, respectively.
Figure 7B:
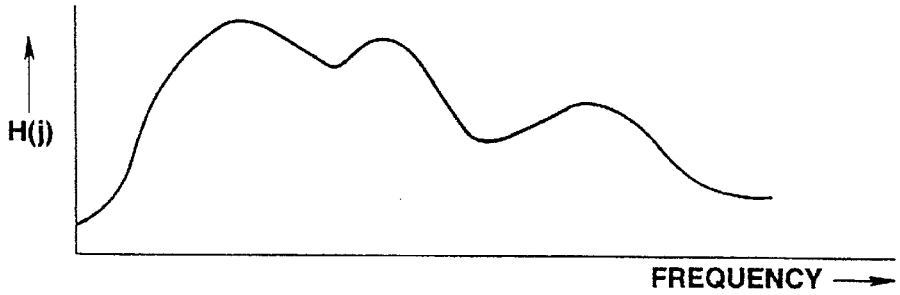
Figure 7C:
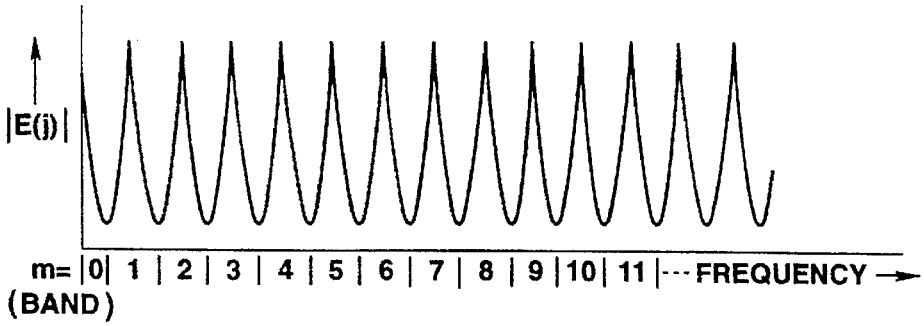

In the above formula, J corresponds to $\omega_s/4\pi=f_s/2$, and thus corresponds to 4 kHz when the sampling frequency $f_s=\omega_s/2\pi$ is, e.g., 8 kHz. In the above formula (4), when the spectrum data S(j) on the frequency base is a waveform as shown in FIG. 7A, H(j) indicates a spectrum envelope of the original spectrum data SQ) as shown in FIG. 7B, and E(j) indicates spectrum of an equal level and periodic excitation signal as shown in FIG. 7C. Namely, the FFT spectrum S(j) is modeled as a product of the spectrum envelope H(j) and the power spectrum |E(j)| of the excitation signal.

The above-mentioned power spectrum |E(j)| of the excitation signal is formed by arranging the spectrum waveforms corresponding to one frequency band in a manner to repeat at respective bands on the frequency base by taking into consideration the periodicity (pitch structure) of the waveform on the frequency base determined in accordance with the pitch. The waveform of one band can be formed by considering a waveform in which 0 data of 1792 samples are added to the Hamming window function of 256 samples as shown in FIG. 4B, for example, to be a time base signal to implement the FFT processing thereto to extract an impulse waveform having a certain band width on the frequency base thus obtained in accordance with the pitch.

Then, such values to represent the H(j) (a sort of amplitude to minimize errors every respective bands) $|A_m|$ are determined for each respective band divided in accordance with the pitch. Here, when, e.g., the lower limit and the upper limit of the m-th band (band of the m-th harmonic) are respectively represented by $a_m$, $b_m$, the error $\epsilon_m$ of the m-th band is expressed by the following formula (5):

$$\epsilon_m=\sum_{j=a_m}^{b_m}\{|S(j)|-|A_m||E(j)|\}^2 \tag{5}$$

An $|A_m|$ to minimize this error $\epsilon_m$ is expressed by the following formula:

$$\begin{aligned}\frac{\partial\epsilon_m}{\partial|A_m|} &= -2\sum_{j=a_m}^{b_m}\{|S(j)|-|A_m||E(j)|\}|E(j)| \\ &= 0 \\ \therefore|A_m| &= \sum_{j=a_m}^{b_m}|S(j)||E(j)|/\sum_{j=a_m}^{b_m}|E(j)|^2\end{aligned} \tag{6}$$

At the time of $|A_m|$ of the formula (6), error $\epsilon_m$ is minimized.

Such amplitudes $|A_m|$ are determined for each every respective band. Respective amplitudes $|A_m|$ thus obtained are used to determine errors $\epsilon_m$ for each respective band defined in the above-mentioned formula (5). Then, the sum total value $\Sigma\epsilon_m$ of all of bands of errors $\epsilon_m$ for each respective band as stated above is determined. Further, such error sum total values $\Sigma\epsilon_m$ of all bands are determined with respect to several pitches minutely different to determine a pitch such that the error sum total value $\Sigma\epsilon_m$, becomes minimum.

Namely, several kinds of pitches are prepared in an upper and a lower direction at 0.25 pitches, for example, with a rough pitch determined at the pitch extraction section 13 being as center. With respect to the pitches of several kinds of pitches which are minutely different, the error sum total values $\Sigma\epsilon_m$ are respectively determined. In this case, when a pitch is determined, the band width is determined. The error $\epsilon_m$ of the formula (5) is determined by using a power spectrum |S(j)| and an excitation signal spectrum |E(j)| of data on the frequency base by the above formula (6), thus making it possible to determine the sum total value $\Sigma\epsilon_m$ of all bands. These error sum total values $\Sigma\epsilon_m$ are determined for each pitch to determine, as an optimum pitch, a pitch corresponding to the error sum total value which is minimized. In a manner stated above, at the fine pitch search section 16, an optimum fine pitch (e.g., 0.25 pitches) is determined, and the amplitude $|A_m|$ corresponding to the optimum pitch is determined. A calculation of the amplitude value at this time is carried out at an amplitude evaluation section 18 V of the voiced sound.

While the case where the speech signal components in all of the bands are Voiced Sound for simplifying the description in the above-described explanation of a fine search of pitch is assumed, since there is employed the model where an Unvoiced area exists on the frequency base of the same time in the MBE vocoder as described above, it is required to carry out a discrimination between Voiced Sound and Unvoiced Sound for each respective band.

The optimum pitch from the fine pitch search section 16 and the data of amplitude $|A_m|$ from the amplitude evaluation section 18 V of voiced sound are sent to voiced sound/unvoiced sound discrimination section 17, at which discrimination between a voiced sound and an unvoiced sound is carried out for each respective band. For this discrimination, NSR (Noise-to-Signal Ratio) is utilized. Namely, NSRm which is the NSR of the m-th band is expressed as follows:

$$NSR_m=\frac{\sum_{j=a_m}^{b_m}\{|S(j)|-|A_m||E(j)|\}^2}{\sum_{j=a_m}^{b_m}|S(j)|^2} \tag{7}$$

When this $NSR_m$ is greater than a predetermined threshold value $Th_1$ (e.g., $Th_1=0.2$) (i.e., error is great), an approximation of |S(j)| by $|A_m|$ |E(j)| at that band is judged to be unsatisfactory (the excitation signal |E(j)| is improper as a basis). Thus, this band is discriminated as UV (Unvoiced). When, except for the above, it can be judged that an approximation is carried out satisfactorily to some extent, thus that band is discriminated as V (Voiced).

Meanwhile, since the number of bands divided by the fundamental pitch frequency (the number of harmonics) fluctuates in the range of about 8~63 in dependency upon loudness (length of pitch) as described above, the number of the respective V/UV flags similarly fluctuates.

In view of this, in this embodiment, an approach is employed to combine (or carry out degeneration of) V/UV discrimination results for each one of a predetermined number of bands divided by a fixed frequency band. In more a practical sense, a predetermined frequency band (e.g., 0~4000 Hz) including a speech (voice) band is divided into $N_B$ (e.g., twelve) number of bands to discriminate, for example, a weighted mean value by a predetermined threshold value $Th_2$ (e.g., $Th_2$=0.2) in accordance with the NSR values within the respective bands to judge the V/UV condition of the corresponding band. Here, $NS_n$ which is the $N_s$ value of the n-th band ($0 \leqq n < N_B$) is expressed by the following formula (8):

$$NS_n = \frac{\sum_{i=L_n}^{H_n-1} |A_i| NSR_i}{\sum_{i=L_n}^{H_n-1} |A_i|} \tag{8}$$

In the above formula (8), Ln and Hn indicate the respective integer values obtained by dividing the lower limit frequency and the upper limit frequency in the n-th band by the fundamental pitch frequency, respectively.

Figure 8:
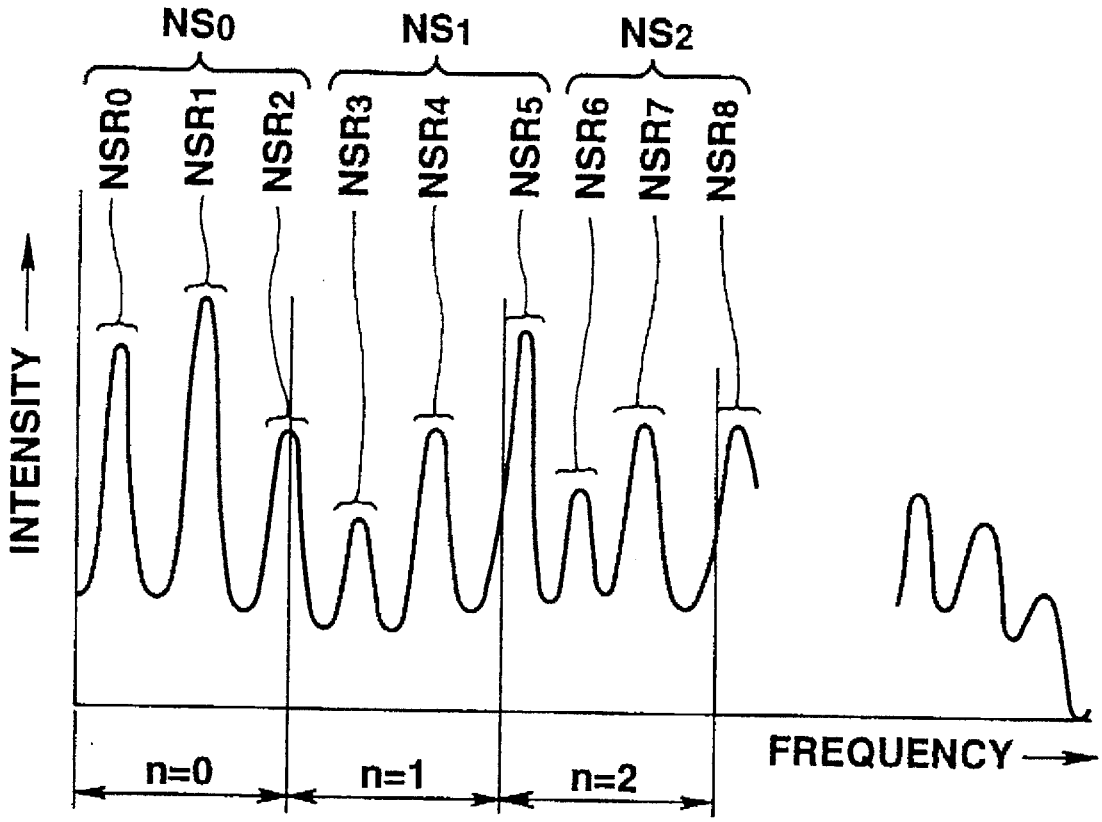
FIG. 8 is an illustration for explaining processing for allowing bands divided in pitch period units to degenerate into a predetermined number of bands.

Accordingly, as shown in FIG. 8, an $NSR_m$ such that the center of the harmonics falls within the n-th band is used for discrimination of $NS_n$.

In a manner stated above, V/UV discrimination results with respect to the $N_B$ (e.g., $N_B$=12) bands are obtained. Then, processing for converting them into discrimination results of a pattern having one change point of voiced sound/unvoiced sound or less where the speech signal components in the frequency band on a lower frequency side are caused to be voiced sound and the speech signal components in the frequency band on a higher frequency side are caused to be unvoiced sound is carried out. As an actual example of this processing, as disclosed by the specification and the drawings of PCT/JP93/00323 by this applicant, it is proposed to detect the highest frequency band (where speech signal components are) caused to be V (Voiced Sound) to allow (speech signal components of) all bands on a lower frequency side less than this band to be V (Voiced Sound) and to allow speech signal components of the remaining higher frequency side to be UV (Unvoiced Sound). In this embodiment, the following conversion processing is carried out.

Namely, when V/UV discrimination result of the K-th band is assumed to be $D_k$, an $N_B$-dimensional vector consisting of V/UV discrimination results of $N_B$ (e.g., $N_B$=12) bands, e.g., twelve dimensional vector VUV is expressed as follows:

$$VUV=(D_0, D_1, \ldots, D_{11})$$

Then, the vector in which the Hamming distance between this vector and the vector VUV is the shortest is searched from thirteen (generally, $N_B$+1) representative vectors described below:

$$VC_0=(0, 0, 0, 0, 0, 0, 0, 0, 0, 0, 0, 0)$$

$$VC_1=(1, 0, 0, 0, 0, 0, 0, 0, 0, 0, 0, 0)$$

$$VC_2=(1, 1, 0, 0, 0, 0, 0, 0, 0, 0, 0, 0)$$

$$VC_3=(1, 1, 1, 0, 0, 0, 0, 0, 0, 0, 0, 0) \ldots$$

$$VC_{11}=(1, 1, 1, 1, 1, 1, 1, 1, 1, 1, 1, 0)$$

$$VC_{12}=(1, 1, 1, 1, 1, 1, 1, 1, 1, 1, 1, 1)$$

It should be noted that, with respect to values of respective elements $D_0$, $D_1$, . . . of the vector, the band of UV (Unvoiced Sound) is assumed to be 0 and band of V (Voiced Sound) is assumed to be 1. Namely, V/UV discrimination result $D_k$ of the k-th band is expressed below by the $NS_k$ Of the k-th band and the threshold value $Th_2$:

$$\text{When } NS_k < Th_2,\ D_k=1$$

$$\text{When } NS_k \geqq Th_2,\ D_k=0$$

Alternatively, in calculation of the Hamming distance, it is conceivable to add weight. Namely, the above-mentioned representative vector $VC_n$ is defined as follows:

$$VC_n=(C_0), C_1 \ldots, C_k \ldots, C_{NB-1})$$

In the above formula, when k<n, $C_k$=1 and when $k \geqq n$, $C_k$=0. Further, the weighted Hamming distance WHD is assumed to be expressed as follows:

$$WHD = \sum_{k=0}^{N_g-1} |C_k - D_k| A_K W_k \tag{9}$$

It should be noted that $A_k$ in the above formula (9) is the mean value within a band of Am having a center of harmonics at the k-th band ($0 \leqq k < N_B$) similarly to the above-mentioned formula (8). Namely, $A_k$ is expressed as follows:

$$A_k = \frac{\sum_{i=L_k}^{H_k-1} |A_i|}{H_k - L_k} \tag{10}$$

In the above formula (10), $L_k$ and $H_k$ represent the respective integer values of values obtained by dividing the lower limit frequency and the upper limit frequency in the k-th band by the fundamental pitch frequency, respectively. The denominator of the above-mentioned formula (10) indicates how many harmonics exist at the k-th band.

In the above-mentioned formula (9), $W_k$ may employ a fixed weighting such that importance to, e.g., the lower frequency side is attached, i.e., its value takes a greater value according as k becomes smaller.

By a method as stated above, or the method disclosed in the specification and the drawings of PCT/JP93/00323, V/UV discrimination data of $N_B$ bits (e.g., when $N_B$=12, $2^{12}$ kinds of combinations may be employed) can be reduced to ($N_B$+1) kinds (13 kinds when, e.g., $N_B$=12) of combinations of the $VC_0$~$VC_{NB}$. Although this processing is not necessarily required in implementation of this invention, it is preferable to carry out such a processing.

The processing for carrying out the expansion of the V/UV discrimination result on a lower frequency side to a higher frequency side, which is an important point of the embodiment according to this invention, will now be described. In this embodiment, there is carried out an expansion such that when the V/UV discrimination result of a predetermined number of bands less than a first frequency on a lower frequency side is V (Voiced Sound), a predetermined band up to a second frequency on a higher frequency side is caused to be considered as V under a predetermined condition, e.g., the condition where the input signal level is greater than a predetermined threshold value $Th_s$ and a zero cross rate of the input signal is smaller than a predetermined threshold value $Th_z$. Such an expansion is based on the observation that there is the tendency that the structure (the degree of influence of the pitch structure) of a lower frequency portion of the spectrum structure of speech voice represents the entire structure.

As the first frequency on the lower frequency side, it is conceivable to employ, e.g., 500~700 Hz. As the second frequency on the higher frequency side, it is conceivable to employ, e.g., 300 Hz. This corresponds to implementation of an expansion such that in the case where a frequency band including the ordinary voice frequency band 200~3400 Hz, e.g., a frequency band up to 4000 Hz, is divided by a predetermined number of bands, e.g., 12 bands, then when, e.g., a V/UV discrimination result of 2 bands on the lower frequency side (which is a band less than the first frequency) is V(Voiced Sound), then the bands except for 2 bands from the higher frequency side which are band up to the second frequency on the higher frequency side are caused to be V.

Namely, attention is first drawn to values of two (the 0-th and the first) elements $C_0$, $C_1$ from the left (from the lower frequency band side) of vector of $VC_n$ or VUV obtained by the above-mentioned processing. In a more practical sense, in the case where VCn satisfies the condition where $C_0=1$ and $C_1=1$ (2 bands on the lower frequency side are V), if input signal level Lev is greater than a predetermined threshold value $Th_s$ ($Lev>Th_s$) $C_2=C_3=\ldots=C_{NB-3}=1$ is caused to hold irrespective of values of $C_2$~$C_{NB-3}$. Namely, $VC_n$ before expansion and $VC_n'$ after expansion are expressed as follows:

$$VC_n=(1, 1, x, x, x, x, x, x, x, x, 0, 0)$$

$$VC_n'=(1, 1, 1, 1, 1, 1, 1, 1, 1, 1, 0, 0)$$

In the above formula, x is an arbitrary value of 1, 0.

In another expression, when n of $VC_n$ is expressed as $2 \leqq n < N_B-2$, if $Lev>Th_s$, $n=N_B-2$ is caused to compulsorily hold.

It is to be noted that the above-mentioned input signal level Lev is expressed as follows:

$$Lev=\sqrt{\sum_{i=0}^{N-1}\{x(i)w(i)\}^2/N} \tag{11}$$

In the above formula, N is the number of samples of one block, e.g., N=256.

As an actual example of the threshold value The, a setting may be made such that $Th_s=700$. This value of 700 corresponds to about −30 dB in the case where the decibel value at the time of the sine wave of a full scale is 0 dB when the input sample x(i) is represented by 16 bits.

Further, it is conceivable to take into consideration a zero cross rate of an input signal or pitch, etc. Namely, the condition where the zero cross rate Rz of the input signal is smaller than a predetermined threshold value $Th_z$ ($Rz<Th_z$), or the condition where the pitch period p is smaller than a predetermined threshold value $T_p$ ($p<Th_p$) may be added to the above-mentioned condition (an AND condition of the both is taken). As an actual example of these threshold values $Th_z$, $Th_p$, $Th_z=140$ and $Th_p=50$ may be employed when it is assumed that sampling rate is 8 kHz and the number of samples within one block is 256 samples.

The above-mentioned conditions are collectively recited below:

(1) Input signal $Lev>Th_s$ (2) $C_0=1$ and $C_1=1$ (3) Zero cross rate $Rz<Th_z$ or pitch period $p<Thp$. When all of these conditions (1)~(3) are satisfied, it is sufficient to carry out the above-mentioned expansion.

It is to be noted that the condition where n of $VC_n$ is expressed as $2 \leqq n \leqq N_B-2$ may be employed as the condition of the above mentioned item (2). In more generalized expression, the above condition may be expressed as $n_1 \leqq n \leqq n_2$ ($0<n_1<n_2<N_B$).

Moreover, it is also conceivable to vary the quantity of conditions to expand the section of V (Voiced Sound) on a lower frequency side to a higher frequency side, e.g., input signal level, pitch intensity, the state of V/UV of the former frame, zero cross rate of input signal, or the pitch period, etc. In more generalized expression, conversion from $VC_n$ to $VC_n'$ can be described as follows:

$$VC_n \rightarrow VC_n',\ n'=f(n, Lev, \ldots)$$

Namely, mapping from n to n' is carried out by function f (n, Lev, . . . ). It is to be noted that the relationship expressed as $n' \geqq n$ must hold.

Amplitude evaluation section 18U of unvoiced sound is supplied with data on the frequency base from orthogonal transform section 15, fine pitch data from pitch search section 16, data of amplitude $|A_m|$ from voiced sound amplitude evaluation section 18 V, and V/UV (Voiced Sound/Unvoiced Sound) discrimination data from the voiced sound/unvoiced sound discrimination section 17. This amplitude evaluation section (Unvoiced Sound) determines the amplitude for a second time (i.e., carries out reevaluation of amplitude) with respect to band which has been discriminated as Unvoiced Sound (UV) at the Voiced Sound/Unvoiced Sound discrimination Section 17. This amplitude $|A_m|_{UV}$ relating to band of UV is determined by the following formula:

$$|A_m|_{UV}=\sqrt{\sum_{j=a_m}^{b_m}|S(j)|^2/(b_m-a_m+1)} \tag{12}$$

Data from the amplitude evaluation section (unvoiced sound) 18U is sent to a data number conversion (a sort of sampling rate conversion) section 19. This data number conversion section 19 to allow the number of data to be a predetermined number of data by taking into consideration the fact that the number of the divisional frequency bands on the frequency base varies in dependency upon the pitch, so the number of data (particularly, the number of amplitude data) varies. Namely, when the effective frequency, band is, e.g., a frequency band up to 3400 Hz, this effective band is divided into 8~63 bands in dependency upon 28 the pitch. As a result, the number $m_{MX}+1$ of amplitude $|A_m|$ (also including amplitude $|A_m|_{UV}$ of UV band) data obtained for each band varies from 8~63. For this reason, the data number conversion section 19 converts the variable number $m_{MX}+1$ of the amplitude data into a predetermined number M (e.g., 44) of data.

In this embodiment dummy data to interpolate values from the last data within a block up to the first data within a block is added to the amplitude data of one block of the effective frequency band on the frequency base. This is done to expand the number of data to $N_F$, and thereafter to implement oversampling of 0s times (e.g., octuple) of the band limit type. By this means it is possible to determine 0s times number ($(m_{MX}+1)\times 0s$) of amplitude data and linearly interpolate such 0s times number of amplitude data to further expand its number to a number $N_M$ (e.g., 2048) to thereby implement thinning to the $N_M$ data and convert it into the predetermined number M (e.g., 44) of data.

Data (the predetermined number M of amplitude data) from the data number conversion section 19 is sent to vector quantizing section 20, at which vectors are generated as bundles of the predetermined number of data. Then, vector quantization is implemented thereto. The main part of the quantized output data from the vector quantizing section 20 is sent to a coding section 21 together with fine pitch data from the fine pitch search section 16 and Voiced Sound/Unvoiced Sound (V/UV) discrimination data from the Voiced Sound/Unvoiced Sound discrimination section 17, at which they are coded.

It is to be noted that while these respective data are obtained by implementing processing of data within the block of N samples (e.g., 256 samples), since the block is advanced with a frame of the L samples being as a unit, data to be transmitted is obtained in the frame unit. Namely, pitch data, V/UV discrimination data and amplitude data are updated at the frame pitch. Moreover, with respect to V/UV discrimination data from the voiced sound/unvoiced sound discrimination section 17, they are reduced to (are caused to degenerate into) about 12 bands as the occasion demands as described above. This data pattern indicates a V/UV discrimination data pattern having one divisional position between a Voiced Sound (V) area and an Unvoiced Sound (UV) area or less in all of the bands, and such that the V (Voiced Sound) on a lower frequency side is expanded to a higher frequency band side in the case where a predetermined condition is satisfied.

At the coding section 21, e.g., CRC addition and rate ½ convolution code adding processing are implemented. Namely, important data of the pitch data, the Voiced Sound/Unvoiced Sound (V/UV) discrimination data, and the quantized Output data are caused to undergo CRC error correcting coding, and are then caused to undergo convolution coding. Coded output data from the coding section 21 is sent to frame interleaving section 22, at which it is caused to undergo interleaving processing along with a portion (e.g., low importance) data from vector quantizing section 20. The data thus processed is taken out from output terminal 23, and is then transmitted to the synthesis side (decode side). Transmission in this case includes recording onto a recording medium and reproduction therefrom.

The outline of the configuration of the synthesis side (decode side) for synthesizing a speech signal on the basis of the respective data obtained after it has undergone transmission will now be described with reference to FIG. 9.

Figure 9:
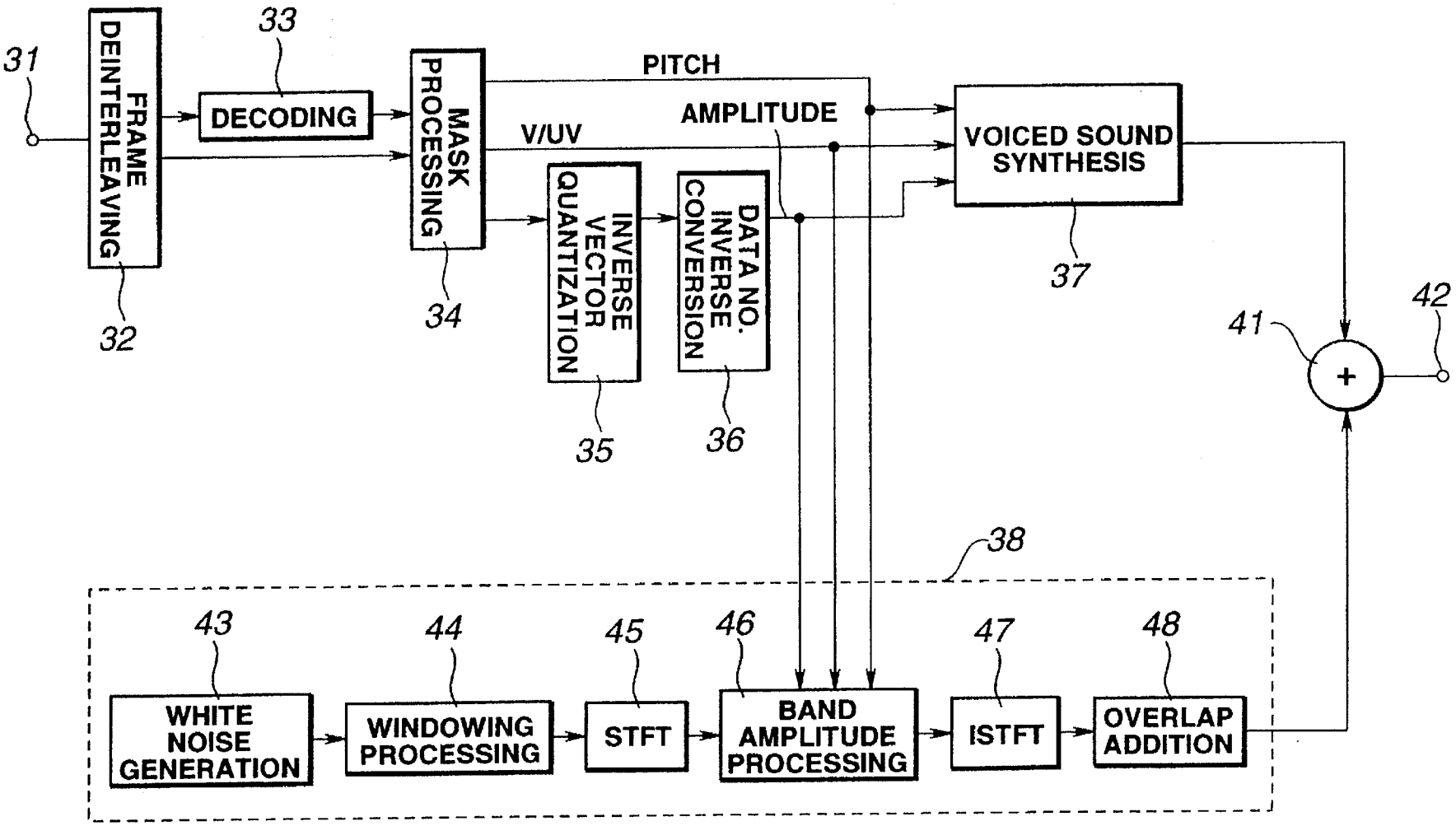
FIG. 9 is a functional block diagram showing an outline of the configuration of the synthesis side (decode side) of the speech analysis/synthesis apparatus according to this invention.

In FIG. 9, an input terminal 31 is supplied (in a manner to disregard signal deterioration by transmission or recording/reproduction) with a data signal substantially equal to a data signal taken out from the output terminal 23 on the encoder side shown in FIG. 3. Data from the input terminal 31 is sent to a frame deinterleaving section 32, at which deinterleaving processing complementary to the interleaving processing of FIG. 3 is implemented thereto. A data portion of high importance (a portion caused to undergo CRC and convolution coding on the encoder side) of the data thus processed is caused to undergo decode processing at a decoding section 33, and the data thus processed is sent to a mask processing section 34. On the other hand, the remaining portion (i.e., data having a low importance) is sent to the mask processing section 34 as it is. At the decoding section 33, e.g., so called Viterbi decoding processing and/or error detection processing using a CRC check code are implemented. The mask Processing section 34 carries out such a processing to determine the parameters of a frame having many errors by interpolation, and separates and takes out the pitch data, Voiced Sound/Unvoiced Sound (V/UV) data, and vector quantized amplitude data.

The vector quantized amplitude data from the mask processing section 34 is sent to an inverse vector quantizing section 35, at which it is inverse-quantized. The inverse-quantized data is further sent to a data number inverse conversion section 36, at which data number inverse conversion is implemented. At the data number inverse conversion section 36, inverse conversion processing complementary to that of the above-described data number conversion section 19 of FIG. 3 is carried out. Amplitude data thus obtained is sent to a voiced sound synthesis section 37 and an unvoiced sound synthesis section 38. The pitch data from the mask processing section 34 is sent to the voiced sound synthesis section 37 and unvoiced sound synthesis section 38. In addition, the V/UV discrimination data from the mask processing section 34 is also sent to the voiced sound synthesis section 37 and unvoiced sound synthesis section 38.

The voiced sound synthesis section 37 synthesizes voiced sound waveform on the time base, e.g., by cosine synthesis. The unvoiced sound synthesis section 38 carries out filtering of, e.g., white noise by using a band-pass filter to synthesize the unvoiced sound waveform on the time base. The voiced sound synthetic waveform and the unvoiced voice synthetic waveform are additively synthesized at adding section 41 and output from output terminal 42. In this case, the amplitude data, pitch data and V/UV discrimination data are updated every one frame (L samples, e.g., 160 samples) at the time of synthesis. In order to enhance (smooth) continuity between frames, values of the amplitude data and the pitch data are caused to be respective data values, e.g., at the central position of one frame to determine respective data values between this center position and the center position of the next frame by interpolation. Namely, at one frame at the time of synthesis, respective data values at the leading sample point and respective data values at the terminating sample point are given to determine respective data values between these sample points by interpolation.

Moreover, it is possible to divide all bands into a Voiced Sound (V) area and an Unvoiced Sound (UV) area at one divisional position in dependency upon V/UV discrimination data. Thus, it is possible to obtain V/UV discrimination data for each respective band in dependency upon this division. There are instances where, with respect to this divisional position, V on the lower frequency side is expanded to the higher frequency side as described above. Here, in the case where all bands are reduced to (are caused to degenerate into) a predetermined number (e.g., about 12) bands on the analysis side (encoder side), it is possible to restore them into a variable number of bands at intervals corresponding to the original pitch.

The synthesis processing in the voiced sound synthesis section 37 will now be described in detail.

When voiced sound of the one synthetic frame (L samples, e.g., 160 samples) on the time base in the m-th band (of which speech signal components are) discriminated as the V (Voiced Sound) is assumed to be $V_m(n)$, this voiced sound $V_m(n)$ is expressed by using time index (sample No.) within this synthetic frame as follows:

$$V_m(n)=A_m(n)\cos(\theta_m(n))\quad 0\leqq n<L \tag{13}$$

Thus, voiced sounds of all bands of which the speech signal components have been discriminated as V (Voiced Sound) in all bands are added ($\Sigma V_M(n)$) to synthesize the ultimate voiced sound V(n).

$A_m(n)$ in the above-mentioned formula (13) indicates the amplitude of the m-th harmonics interpolated from the leading end to the terminating end of the synthetic frame. To realize this by the simplest method, it is sufficient to carry out linear interpolation of the value of the m-th harmonic of the amplitude data updated in a frame unit. Namely, when the amplitude value of the m-th harmonic at the leading end (n=0) of the synthetic frame is assumed to be $A_{0m}$, and the amplitude value of the m-th harmonic at the terminating end (n=L) of the synthetic frame is assumed to be $A_{Lm}$, it is sufficient to calculate $A_m(n)$ by the following formula:

$$A_m(n)=(L-n)A_{0m}/L+nA_{Lm}/L \tag{14}$$

Phase $\theta_m(n)$ in the above-mentioned formula (13) can be determined by the following formula:

$$\theta_m(n)=m\omega_{01}n+n^2m(\omega_{L1}-\omega_{01})/2L+\Phi_{0m}+\Delta\omega n \tag{15}$$

In the above-mentioned formula (15), $\Phi_{0m}$ indicates the phase (frame initial phase) of the m-th harmonic at the leading end of the synthetic frame, $\omega_{01}$ indicates the fundamental angular frequency at the synthetic frame initial end, and $\omega_{L1}$ indicates the fundamental angular frequency at the terminating end (n=L) of the synthetic frame. $\Delta\omega$ in the above-mentioned formula (15) is set to such a minimum that the phase $\Phi_{Lm}$ at n=L is equal to $\theta_m(L)$.

A method of respectively determining the amplitude $A_m(n)$ and phase $\theta_m(n)$ corresponding to V/UV discrimination result when n=0 and n=L at the arbitrary m-th band will now be described.

In the case where the speech signal components of the m-th band (are) is caused to be V(Voiced Sound) at both n=0 and n=L, it is sufficient to linearly interpolate transmitted amplitude values $A_{0m}$, $A_{Lm}$ to calculate amplitude $A_m(n)$ by the above-described formula (14). With respect to phase $\theta_m(n)$, the setting of $\Delta\omega$ is made such that $\theta_m(0)$ is equal to $\Phi_{0m}$ at n=0 and m(L) is equal to $\Phi_{Lm}$ at n=L.

In the case where the m-th band is caused to be V(Voiced Sound) at n=0 and the m-th band is caused to be UV (Unvoiced Sound) at n=L, linear interpolation of amplitude $A_m(n)$ is carried out so that it becomes equal to transmission amplitude value $A_{0m}$ at $A_m(o)$ and becomes equal to 0 at $A_m(L)$. Transmission amplitude value $A_{Lm}$ at n=L is the amplitude value of unvoiced sound, and it is used in unvoiced sound synthesis which will be described later. The phase $\theta_m(n)$ is set so that $\theta_m(o)$ becomes equal to $\Phi_{0m}$ and $\Delta\omega$ becomes equal to zero.

Further, in the case where the m-th band is caused to be UV (Unvoiced Sound) at n=0 and the m-th band is caused to be V (Voiced Sound) at n=L, the amplitude $A_m(n)$ is linearly interpolated so that the amplitude $A_m(0)$ at n=0 is equal to zero and the amplitude $A_m(n)$ is equal to phase $A_{Lm}$ transmitted at n=L. With respect to phase $\theta_m(n)$, phase $\theta_m(0)$ at n=0 is caused to be expressed by the following formula by using phase value $\Phi_{Lm}$ at the frame terminating end:

$$\theta_m(0)=\Phi_{Lm}-m(\omega_{01}+\omega_{L1})L/2 \tag{16}$$

and $\Delta\omega$ is caused to be equal to zero.

A technique for setting $\Delta\omega$ so that $\theta_m(L)$ is equal to $\Phi_{Lm}$ in the case where the speech signal components of the m-th band at n=0, n=L mentioned above are caused to be both V (Voiced Sound) will now be described. Substitution of n=L into the above-mentioned formula (15) gives:

$$\begin{aligned}\theta_m(L) &= m\omega_{01}L+L^2m(\omega_{L1}-\omega_{01})/2L+\phi_{0m}+\Delta\omega L\\ &= m(\omega_{01}+\omega_{L1})L/2+\phi_{0m}\Delta\omega L\\ &= \phi_{Lm}\end{aligned}$$

When rearrangement of the above-mentioned formula is made, $\Delta\omega$ is expressed as follows:

$$\Delta\omega=(\mathrm{mod}\ 2\pi((\Phi_{Lm}-\Phi_{0m})-mL(\omega_{01}+\omega_{L1})/2)/L \tag{17}$$

Mod2π(x) in the above-mentioned formula (17) is a function in which the main value repeats between−π~+π. For example, when x=1.3 π, mod2π(x)=−0.7 π, when x=2.3 π, mod2π(x)=0.3 π, and when x=−1.3 π, mod2π(x)=0.7 π, etc.

Unvoiced sound synthesizing processing in the unvoiced sound synthesizing section 38 will now be described.

The white noise signal waveform on the time base from white noise generating section 43 is sent to a windowing processing section 44 to carry out windowing by a suitable window function (e.g., a Hamming window) at a predetermined length (e.g., 256 samples) to implement STFT (Short Term Fourier Transform) processing by STFT processing section 45 to thereby obtain a power spectrum on the frequency base of white noise. The power spectrum from the STFT processing section 45 is sent to a band amplitude processing section 46 to multiply the band judged to be the UV (Unvoiced Sound) by the amplitude $|A_m|_{UV}$, and to allow the amplitude of the band judged to be the V (Voiced Sound) to be equal to zero. This band amplitude processing section 46 is supplied with the amplitude data, pitch data, and V/UV discrimination data from the mask processing section 34 and the data no. inverse conversion section 36.

An output from the band amplitude processing section 46 is sent to an ISTFT (Inverse Short Term Fourier Transform) processing section 47, and the phase is caused to undergo inverse STFT processing by using the phase of the original white noise to thereby transform it into a signal on the time base. An output from ISTFT processing section 47 is sent to an overlap adding section 48 to repeat overlapping and addition while carrying out suitable weighting (so that the original continuous noise waveform can be restored) on the time base thus to synthesize a continuous time base waveform. An output signal from the overlap adding section 48 is sent to the adding section 41.

Respective signals of the voiced sound portion and the unvoiced sound portion which have been synthesized and have been restored to signals on the time base at respective synthesizing sections 37, 38 are added at a suitable mixing ratio by adding section 41. Thus, reproduced speech (voice) signal is taken out from output terminal 42.

Figure 10:
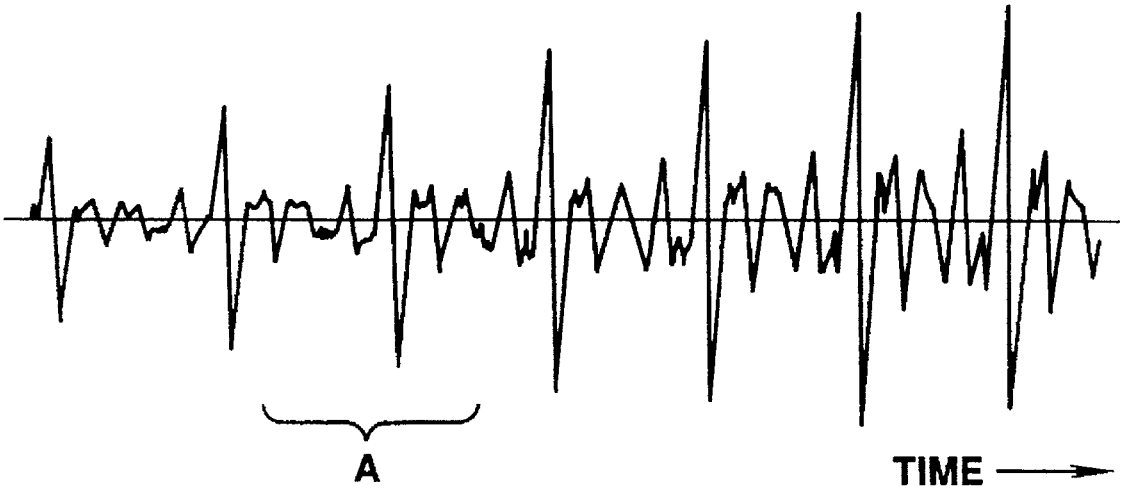
FIG.10 (PRIOR ART)
FIG. 10 is a waveform diagram showing a synthetic signal waveform in the conventional case where processing for carrying out expansion of V (Voiced Sound) discrimination result on a lower frequency side to a higher frequency band side is not carried out.
Figure 11:
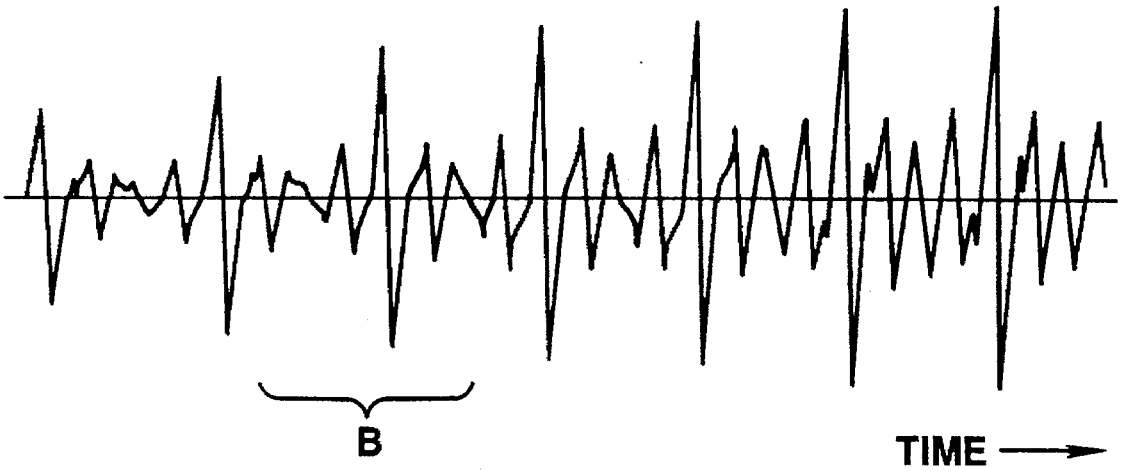
FIG. 11 is a waveform diagram showing a synthetic signal waveform in the case of this embodiment where processing for carrying out expansion of V (Voice Sound) discrimination result on a lower frequency side to a higher frequency side.

FIGS. 10 and 11 are waveform diagrams showing synthetic signal waveform in the conventional case where the above-mentioned processing for expanding V discrimination result on the lower frequency side to the higher frequency side as described above is not carried out (FIG. 10) and synthetic signal waveform in the case where such processing has been carried out (FIG. 11).

Comparison between corresponding portions of waveforms of FIGS. 10 and 11 is made. For example, when portion A of FIG. 10 and portion B of FIG. 11 are compared with each other, it is seen that while portion A of FIG. 10 is a waveform having relatively great unevenness, portion B of FIG. 11 is a smooth waveform. Accordingly, in accordance with the synthetic signal waveform of Fig@-11 to which this embodiment is applied, clear reproduced sound (synthetic sound) having less noise can be obtained.

It is to be noted that this invention is not limited only to the above-described embodiment. For example, with respect to the configuration on the speech (voice) analysis side (encode side) of FIG. 3 and the configuration of the speech (voice) synthesis side (decode side) of FIG. 9, it has been described that the respective components are constructed by hardware, but they may be realized by a software program by using so called DSP (Digital Signal Processor), etc. Moreover, the method of reducing the number of bands for every harmonic, causing them to degenerate into a predetermined number of bands may be carried out as the occasion demands, and the number of degenerate bands is not limited to 12. Further, processing for dividing all of the bands into the lower frequency side V area and the higher frequency side UV area at one divisional position or less may be carried out as the occasion demands, or it is unnecessary to carry out such processing. Furthermore, the technology to which this invention is applied is not limited to the above-mentioned multi-band excitation speech (voice) analysis/synthesis method, but may be easily applied to various voice analysis/synthesis methods using sine wave synthesis. In addition, this invention may be applied not only to transmission or recording/reproduction of a signal, but also to various uses such as pitch conversion, speed conversion or noise suppression, etc.

As is clear from the foregoing description, in accordance with the speech efficient coding method of the present invention, an input voice signal is divided in block units to divide them into a plurality of frequency bands to carry out discrimination between a Voiced Sound (V) and an Unvoiced Sound (UV) for each one of respective divided bands to set a discrimination result of a Voiced Sound/Unvoiced Sound (V/UV) of a frequency band on the lower frequency band in discrimination of Voiced Sound/Unvoiced Sound of frequency band as the discrimination result for a higher frequency band side to thus obtain an ultimate discrimination result of V/UV (Voiced Sound/Unvoiced Sound). In a more practical sense, an approach is employed such that when a frequency band which is less than a first frequency (e.g., 500~700 Hz) on the lower frequency side is discriminated to be a V (Voiced Sound), its discrimination result is used to determine the discrimination result for the higher frequency side to allow a frequency band up to a second frequency (e.g., 3300 Hz) to be compulsorily determined as V (Voiced Sound), thereby making it possible to obtain a clear reproduced sound (synthetic sound) having less noise. Namely, there is employed a method in which the V/UV discrimination result of a frequency band where the harmonics structure is stable on the lower frequency side is used for judging the medium~high frequency band, whereby even in the case where the pitch suddenly changes, or the harmonics structure is not precisely in correspondence with an integer multiple of the fundamental pitch period, a stable judgment of the V (Voiced Sound) can be made. Thus, a clear reproduced sound can be synthesized.

Although the present invention has been shown and described with respect to preferred embodiments, various changes and modifications are deemed to lie within the spirit and scope of the invention as claimed.

What is claimed is:

1. An efficient speech coding method comprising the steps of:

dividing an input speech signal into a plurality of signal blocks in the time domain;

dividing each of the signal blocks into a plurality of frequency bands in the frequency domain;

determining spectrum structures of the frequency bands on the lower frequency side; and deciding that the signal components in the frequency bands on the higher frequency side are voiced sound components or unvoiced sound components in accordance with the determination in the preceding step.

2. An efficient speech coding method as set forth in claim 1 in which discrimination between voiced sound and unvoiced sound based on the spectrum structure on the lower frequency side is modified in dependency upon a zero cross rate of the input speech signal.

3. An efficient speech coding method completing the steps of:

(a) dividing an input digital speech signal in time to provide a plurality of signal blocks;

(b) orthogonally transforming the signal blocks to provide spectral data on the frequency axis;

(c) using multi-band excitation to determine from the spectral data whether each of plural bands obtained by a pitch-dependent division of the spectral data in frequency and which are lower than a first frequency in a first frequency band represents one of a voiced (V) and an unvoiced (UV) sound: and (d) if the discrimination results in step (c) for a determined number of the plural bands is voiced sound, assigning a discrimination result of voiced sound to all of the frequency bands under a second frequency higher than the first frequency to obtain an ultimate discrimination result of voiced sound.

4. An efficient speech coding method as set forth in claim 3, wherein the first frequency is 500~700 Hz.

5. An efficient speech coding method as set forth in claim 3 or 4, wherein the second frequency is 3300 Hz.

6. An efficient speech coding method as set forth in claim 3, wherein only when a signal level of the input speech signal is above a predetermined threshold value is step (d) performed.

7. An efficient speech coding method as set forth in claim 3 or 4, wherein performance of step (d) is controlled in dependency upon a zero cross rate of the input speech signal.

8. An efficient speech coding method comprising the steps of:

(a) dividing an input speech signal into block units on a time base;

(b) dividing signals of each of the respective divided blocks into signals in a plurality of frequency bands;

(c) discriminating whether signals of each of the respective divided frequency ban& which are lower than a first frequency are voiced sound or unvoiced sound;

(d) if the discrimination results in step (c) for a predetermined number of frequency bands is voiced sound, assigning a discrimination result of voiced sound to all frequency bands lower than a second frequency which is higher than the first frequency to obtain an ultimate discrimination result of voiced sound.

9. An efficient speech coding method as set forth in claim 1, 3 or 8, wherein the predetermined number is not less than two.

10. An efficient speech coding method comprising the steps of:

(a) dividing an input speech signal into a plurality of signal blocks in a time domain;

(b) dividing each of the signal blocks into a plurality of frequency bands in a frequency domain;

(c) determining whether a signal component in each of the frequency bands is a voiced sound component or an unvoiced sound component;

(d) determining whether the signal components in a predetermined number of frequency bands below a first frequency are the voiced sound components, and (e) deciding that the signal components in all of the frequency bands below a second frequency higher than the first frequency are the voiced sound components or the unvoiced sound components in accordance with the determination in the preceding step (d).

11. An efficient speech coding method as set forth in claim 1, wherein a decoding processing is executed in dependency upon the ultimate discrimination result of voiced sound or unvoiced sound, the decoding processing comprising the steps of:

sine wave synthesizing a speech signal portion which has been discriminated to be voiced sound: and transform processing a frequency component of a noise signal with respect to a speech signal portion which has been discriminated to be unvoiced sound.

12. An efficient speech coding method as set forth in claim 11, wherein a speech analysis and synthesis method using multi-band excitation is employed.

13. An efficient speech coding method as set forth in claim 1, which, prior to the deciding step (e), further comprises the steps of:

detecting a discrimination result pattern of voiced sound or unvoiced sound for every one of the divided frequency bands so as to provide a pattern having no more than one change point of voiced sound or unvoiced sound where speech signal components in a frequency band below the first frequency are caused to be voiced sound and speech signal components in a frequency band above the second frequency are caused to be unvoiced sound.

14. An efficient speech coding method as set forth in claim 13, wherein a plurality of patterns having no more than one change point of voiced sound or unvoiced sound are prepared in advance as a representative pattern to select a pattern, as an optimum representative pattern, in which a Hamming distance relative to the discrimination result pattern of voiced sound or unvoiced sound is a minimum of the plurality of patterns to thereby carry out the conversion.

15. An efficient speech coding method as set forth in claim 1, wherein the first frequency 500~700 Hz.

16. An efficient speech coding method as set forth in claim 1 or 15, wherein the second frequency is 3300 Hz.

17. An efficient speech coding method as set forth in claim 1, wherein only when a signal level of the input speech signal is above a predetermined threshold value is step (e) performed.

18. An efficient speech coding method as set forth in claim 1 or 17, wherein performance of step (e) is controlled in dependency upon a zero cross rate of the input speech signal.

* * * * *

UNITED STATES PATENT AND TRADEMARK OFFICE

CERTIFICATE OF CORRECTION

PATENT NO. : 5,630,012
DATED : May 13, 1997
INVENTOR(S) : MASAYUKI NISHIGUCHI; JUN MATSUMOTO; JOSEPH CHAN

It is certified that error appears in the above-indentified patent and that said Letters Patent is hereby corrected as shown below:

Column 18, line 12, please change "completing" to --comprising--;

Column 18, line 48, please change "ban&" to --bands--.

Signed and Sealed this

Twenty-first Day of October 1997

*Attest:*

BRUCE LEHMAN

*Attesting Officer*

*Commissioner of Patents and Trademarks*